US012239277B2

(12) United States Patent
Stickel et al.

(10) Patent No.: US 12,239,277 B2
(45) Date of Patent: Mar. 4, 2025

(54) DOMESTIC DISHWASHER HAVING AT LEAST ONE AIR DRYING DEVICE

(71) Applicant: BSH Hausgeräte GmbH, Munich (DE)

(72) Inventors: Martin Stickel, Giengen (DE); Stephan Lutz, Zusamaltheim (DE); Thomas Burggraf, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 478 days.

(21) Appl. No.: 17/638,222

(22) PCT Filed: Aug. 25, 2020

(86) PCT No.: PCT/EP2020/073705

§ 371 (c)(1),
(2) Date: Feb. 25, 2022

(87) PCT Pub. No.: WO2021/052723

PCT Pub. Date: Mar. 25, 2021

(65) Prior Publication Data

US 2022/0296075 A1 Sep. 22, 2022

(30) Foreign Application Priority Data

Sep. 16, 2019 (DE) ..... 10 2019 214 045.9

(51) Int. Cl.
*A47L 15/48* (2006.01)

(52) U.S. Cl.
CPC ..... *A47L 15/486* (2013.01); *A47L 15/481* (2013.01); *A47L 2501/12* (2013.01)

(58) Field of Classification Search
CPC ..... A47L 15/486; A47L 2501/12; A47L 15/00–508
See application file for complete search history.

(56) References Cited

U.S. PATENT DOCUMENTS 2,154,410 A * 4/1939 Polk ..... F24F 7/06 454/346
2,933,240 A * 4/1960 Breese ..... F04D 29/646 310/91
3,064,638 A * 11/1962 Bauer ..... F24H 3/105 454/35

(Continued)

FOREIGN PATENT DOCUMENTS

GB 1530734 A 11/1978
JP 2005058552 A 3/2005

(Continued)

OTHER PUBLICATIONS

International Search Report PCT/EP2020/073705 dated Sep. 24, 2020.
National Search Report CN 2020800650516 dated Oct. 12, 2023.

*Primary Examiner* — Spencer E. Bell
(74) *Attorney, Agent, or Firm* — Michael E. Tschupp; Andre Pallapies; Brandon G. Braun

(57) ABSTRACT

A household dishwasher includes a dishwasher cavity for accommodating an item to be washed held on or in a loading unit and at least one rotatable fan wheel arranged in the dishwasher cavity and designed to take in and blow out air, said at least one rotatable fan wheel being suspended movably, in particular pivotably, in particular at least relative to a vertical axis.

20 Claims, 6 Drawing Sheets

(56) References Cited

U.S. PATENT DOCUMENTS

| | | | | |
|---|---|---|---|---|
| 3,921,228 | A * | 11/1975 | Sundberg | A47K 11/023 4/111.5 |
| 2017/0202423 | A1* | 7/2017 | Kumar | A47L 15/0042 |
| 2017/0311771 | A1 | 11/2017 | Lutz | |
| 2019/0053686 | A1 | 2/2019 | Weigle | |
| 2020/0069147 | A1* | 3/2020 | Sankaran Veerabhagu | A47L 15/4257 |
| 2020/0093346 | A1 | 3/2020 | Lutz | |

FOREIGN PATENT DOCUMENTS

| | | | |
|---|---|---|---|
| JP | 2006130057 | A | 5/2006 |
| KR | 100712277 | B1 | 4/2007 |

* cited by examiner

DOMESTIC DISHWASHER HAVING AT LEAST ONE AIR DRYING DEVICE

CROSS-REFERENCES TO RELATED APPLICATIONS

This application is the U.S. National Stage of International Application No. PCT/EP2020/073705, filed Aug. 12, 2020, which designated the United States and has been published as International Publication No. WO 2021/052723 A1 and which claims the priority of German Patent Application, Serial No. 10 2019 214 045.9, filed Sep. 16, 2019, pursuant to 35 U.S.C. 119 (a)-(d).

The contents of International Application No. PCT/EP2020/073705 and German Patent Application, Serial No. 10 2019 214 045.9 are incorporated herein by reference in their entireties as if fully set forth herein.

BACKGROUND OF THE INVENTION

The present invention relates to a household dishwasher having a dishwasher cavity for accommodating crockery, glasses, flatware or similar items to be washed and having at least one loading unit for accommodating items to be washed.

In a standard dishwashing program a household dishwasher runs through one or multiple fluid-conducting dishwashing sub-cycles, for example a pre-rinse cycle, a cleaning cycle, an intermediate rinse cycle and a final rinse cycle. These are generally followed by a drying cycle. During the respective fluid-conducting dishwashing sub-cycles wash fluid, in other words what is known as wash liquor, is introduced into the dishwasher cavity by way of one or multiple fluid distribution device(s). Such fluid distribution devices can be formed for example by rotating spray arms, by a top-mounted shower and/or by a movable spray nozzle, for example a top-mounted gyroscope, in the dishwasher cavity. These can be used to introduce wash fluid into the dishwasher cavity preferably in such a manner that said wash fluid strikes the items to be washed, which are held there in loading units, for example pull-out racks and/or flatware drawers, directly or indirectly. Water can preferably be used as the wash fluid for the respective fluid-conducting dishwashing sub-cycle, with detergent and/or rinse aid added as required. Fresh water from a household water pipe, which is softened in particular by means of a softening unit of the dishwasher, or process water, which is stored in a storage unit of the dishwasher from the final rinse cycle of the preceding dishwashing program, can preferably be used for the pre-rinse cycle. Fresh water softened by means of the softening unit is preferably used for the cleaning cycle with detergent added. Softened fresh water is preferably used in the intermediate rinse cycle. Fresh water softened by means of the softening unit is preferably used for the final rinse cycle, with rinse aid added. Various drying methods are known for drying the items being washed as effectively as possible at the end of the respective dishwashing program. These include in particular what is known as inherent heat drying, condensation drying (in particular using a heat exchanger on a side wall of the dishwasher cavity for cooling purposes), drying by opening the door at the end of the drying cycle, sorption drying, for example using zeolite, etc. These methods in particular cause fluid droplets that still adhere to the items being washed after the last fluid-conducting dishwashing sub-cycle of a concluding dishwashing program to dry up.

However if fluid collects in an upward facing depression, for example a valley, channel or other cavity in an item being washed, during the fluid-conducting dishwashing sub-cycle of the dishwashing program to be performed and remains on top there, such a standing quantity of fluid is often too great to be dried up by a conventional drying system. A typical example of such a depression is an inward curving bottom of an upside down cup or a corresponding glass. Such standing residual fluid can generally only be eliminated after the end of the drying cycle by a user manually tipping the respective item being washed and/or drying it using a tea towel, which is inconvenient and time-consuming. Also such puddles left in depressions in items being washed after the drying cycle can result in unsightly, stubborn deposits or water stains, as the standing fluid can contain dirt particles, detergent, rinse aid, lime and/or other added substances, which can remain behind in the respective depression after the puddles have dried up completely.

The problem underlying the invention is to provide a household dishwasher with a drying facility, with the aid of which quantities of fluid in particular in uppermost depressions, for example hollows, valleys, channels or other cavities in items being washed that are held in loading units can be largely eliminated during the final drying cycle of a dishwashing program to be performed.

BRIEF SUMMARY OF THE INVENTION

The invention resolves the problem by means of an object with the features of the independent claim. Advantageous embodiments and developments of the invention will emerge from the dependent claims.

Because according to the invention one or multiple rotatable fan wheels that can rotate in the dishwasher cavity is or are assigned to at least one loading unit and/or an upper wall delimiting the dishwasher cavity in a household dishwasher, allowing air to be both taken in and blown out, with individual or multiple fan wheels being suspended movably, in particular pivotably, in particular at least relative to a vertical axis, air can be blown onto items to be washed located below, it being possible for the angle at which the air is blown out to vary.

For example the movable suspension unit of a fan wheel allows said fan wheel to tilt or be tilted from the outside (in particular relative to a vertical axis)—preferably through several degrees—when the speed is increased. This varies the direction of the air flow emitted downward for drying purposes.

If, according to one advantageous variant of the invention, multiple fan wheels are fixed or supported together on a frame—for example next to one another in one plane—and the frame as a whole is suspended movably, in particular relative to a vertical axis, from a loading unit or the wall delimiting the top of the dishwasher cavity, the frame can be raised in a corner region by for example switching on a first fan wheel provided in said corner region of the frame and be tilted as a whole, in particular relative to a vertical axis, as a result. This changes the air flow direction of all the fan wheels held on the frame at the same time.

If, according to one advantageous variant of the invention, the fan wheels on said frame are operated at a changing speed and/or one after the other, the alignment of the frame varies over time so that the resulting air flow (or air flows) change(s) direction repeatedly, thereby optimizing the drying response for items to be washed subjected to the resulting air flow (or air flows). This ensures an improved drying result for the drying cycle of a dishwashing cycle of a dishwashing program to be performed.

If however, according to a further advantageous variant of the invention, the or each fan wheel is suspended individually from the holding frame or the wall delimiting the top of the dishwasher cavity in such a manner that it can move, in particular at least relative to a vertical axis, the air flow of each fan wheel can vary individually. It is possible in particular here to operate with speed variations at each fan wheel in order to achieve—in particular slight—inclination of the respective fan wheel by varying the air flow strength and thus to change the direction of the air flow output or blown out by the respective fan wheel. The air flows of the multiple fan wheels do not have to be parallel to one another here.

The change in the direction of the output air flows can advantageously be facilitated by providing an elastically deformable suspension unit for the frame and/or the fan wheel(s) for the purpose of allowing movement, in particular at least relative to a vertical axis. Elastically deformable suspension units can be provided here for example by way of support elements containing rubber, silicone and/or TPE/TPV. Strips or sealing cuffs for example are possible in the suspension units.

Additionally or alternatively it is also possible to achieve an elastically deformable suspension unit by way of springs.

In one preferred embodiment it is also possible for each fan wheel to be held by way of or by means of multiple suspension units, which have different elasticities. The angular position of the fan wheel and the output air flow then also changes to some degree by way of the upward force brought about by the air flow.

Instead of the elastic elements and/or springs, the exit angle can be varied by way of one or multiple pivot levers in the respective suspension unit. For example a fan wheel can preferably be held by way of an approximately horizontal pivot lever, which can be moved about a horizontal axis with one degree of freedom and therefore allows the fan wheel to move a small distance about the pivot axis on a circular path.

In all instances a change in the blow-out direction can preferably be achieved in particular solely by operating the respective fan wheel, the downward thrust of which preferably moves the fan wheel relative to the vertical. Additionally or alternatively a force can be input from outside to vary the angle, for example by way of an electric motor. This can for example act on multiple pivot levers holding fan wheels by way of cams.

As set out above, if multiple fan wheels are present, these can favorably be activated individually, with the respectively activated fan wheel generating a thrust force, which moves said fan wheel in its suspension unit or the multiple fan wheels around a common suspension unit.

In particular one or multiple fan wheel(s) can be held in its or their rest position in a horizontal loading plane of a loading unit (for example of a rack or flatware drawer) or the upper wall.

The one or multiple fan wheel(s) can preferably be rotated about a vertical axis or vertical axes without varying their position angles.

In other words and/or in more general terms the respective fan wheel can be moved, in particular can be pivoted, in addition to its rotational movement about a rotation axis predefined for it. This allows its rotation axis to assume different positions—preferably during the drying phase of a dishwashing program to be performed—allowing it to blow air flows in different spatial directions in the dishwasher cavity of the household dishwasher.

The drive motor assigned to the respective fan wheel can preferably be arranged above the respective fan wheel so that drive motor and fan wheel form a compact structural unit in each case with only minimal structural height.

If one or multiple fan wheels take in and blow out air from the closed dishwasher cavity, there is no need for outlets in the dishwasher cavity wall or valves or other additional structural units so the structure remains simple. Alternatively it is also possible for air to be taken in from outside, for example by the door being opened automatically to provide a gap.

Further advantages and features will emerge from the exemplary embodiments of the subject matter of the invention illustrated in the drawing and described in the following.

DETAILED DESCRIPTION OF EXEMPLARY EMBODIMENTS OF THE PRESENT INVENTION

Figure 1:
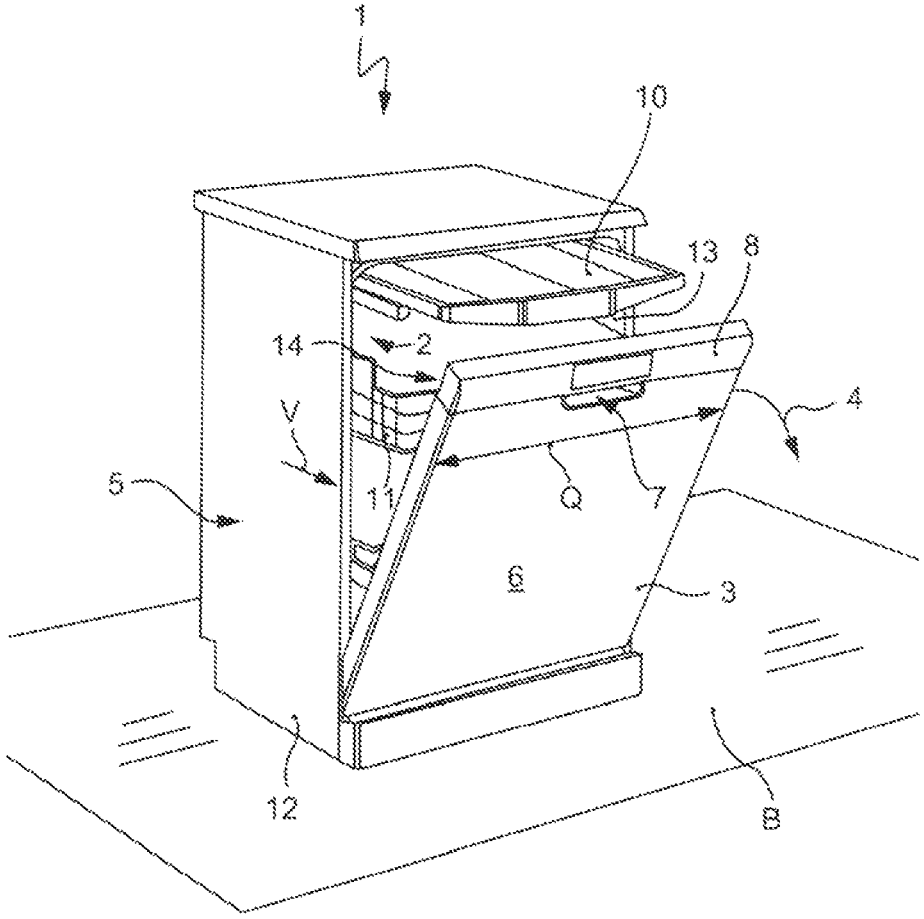
FIG. 1 shows a schematic perspective view obliquely from the front of an embodiment of a household dishwasher with a door at the front here and a dishwasher cavity in the interior.

FIG. 1 shows a schematic diagram of a household dishwasher 1. Part of it comprises an appliance body 5, which is partially open to the outside or closed and is often also referred to as the carcass, at least one dishwasher cavity 2 for accommodating items to be washed, e.g. crockery, pots, flatware, glasses, cooking utensils and the like. The items to be washed can be held for example in loading units 10, 11, specifically according to the drawing in racks 11 and/or a flat flatware drawer 10, being subjected to the action of what is referred to as wash liquor or fluid in the process. Here by way of example two racks 11 are arranged as loading units one above the other and in the upper region of the dishwasher cavity 2 there is an additional loading unit in the form of a flatware drawer 10. This arrangement is not mandatory. If there are bulky items to be washed, the customer can also remove an upper rack 11 or the flatware drawer 10 for example for a specific dishwashing cycle. In contrast no flatware drawer 10 is provided in the examples in the further figures.

Wash liquor refers to fresh water or water that is circulating, in particular during operation, preferably softened and with or without detergent and/or rinse aid and/or drying agent. The dishwasher cavity 2 can have an at least substantially rectangular—in particular approximately square—footprint with a front face V that faces a user in the operating position. Said front face V can form part of a kitchen front made up of adjacent kitchen units or in the case of a freestanding appliance it may have no connection to other units.

The dishwasher cavity 2 can be closed by a door or flap 3 in particular at its front face V. Said door 3 is shown in FIG. 1 in its partially opened position, where it is at an angle to the vertical. In contrast in its closed position it is upright and according to the drawing can be pivoted forward and downward in the direction of the arrow 4 about a lower horizontal axis for opening, so that it is at least approximately horizontal in the fully opened position.

The door 3 can be provided with a decorative panel 6 on its outer and front face V, which faces the user and is vertical in the closed position, thereby improving its visual and/or haptic qualities and/or matching the surrounding kitchen units.

The household dishwasher 1 here is configured as a freestanding or what is referred to as a partially integrated or fully integrated appliance. In the last instance the appliance body 5 can also line up substantially with the outer walls of the dishwasher cavity 2. A housing enclosing it on the outside can then be dispensed with wholly or partially. A base 12 for accommodating functional elements in particular, and for example a circulation pump and/or drain pump for the wash liquor, can be located in the lower region of the dishwasher.

In the exemplary embodiment according to the drawing the movable door 3 is assigned a control panel 8 extending in the transverse direction Q of the dishwasher in its upper region, which can comprise a grip opening 7 accessible from the front face V for opening and/or closing the door 3 manually. The dishwasher frequently has an extension of 45, 50 or 60 centimeters in the transverse direction Q. The extension to the rear in the depthwise direction from the front face V is frequently also around 60 centimeters. These values are not mandatory.

The dishwasher cavity 2 is delimited peripherally when the door or flap 3 is closed by a total of three fixed vertical walls 13 and two horizontal walls 15, one of which is an upper wall forming the top and another is a lower delimitation of the dishwasher 2 forming the bottom. The wall 14 arranged at the front face V facing a user standing in front of the dishwasher 1 and movable here forms an internal component of the movable door or flap 3.

The wall 15 forming the bottom of the dishwasher cavity 2 and substantially delimiting it in a downward direction is, like the upper wall 15, approximately horizontal, in other words parallel to an external floor B on which the dishwasher 1 stands.

At least one of the loading units 10, 11 is or are assigned one or multiple fan wheels L1, L2, L3, L4 that can rotate in the dishwasher cavity 2 and can be used to take in and blow out air, in particular with a flow component into the dishwasher cavity 2.

Figure 7:
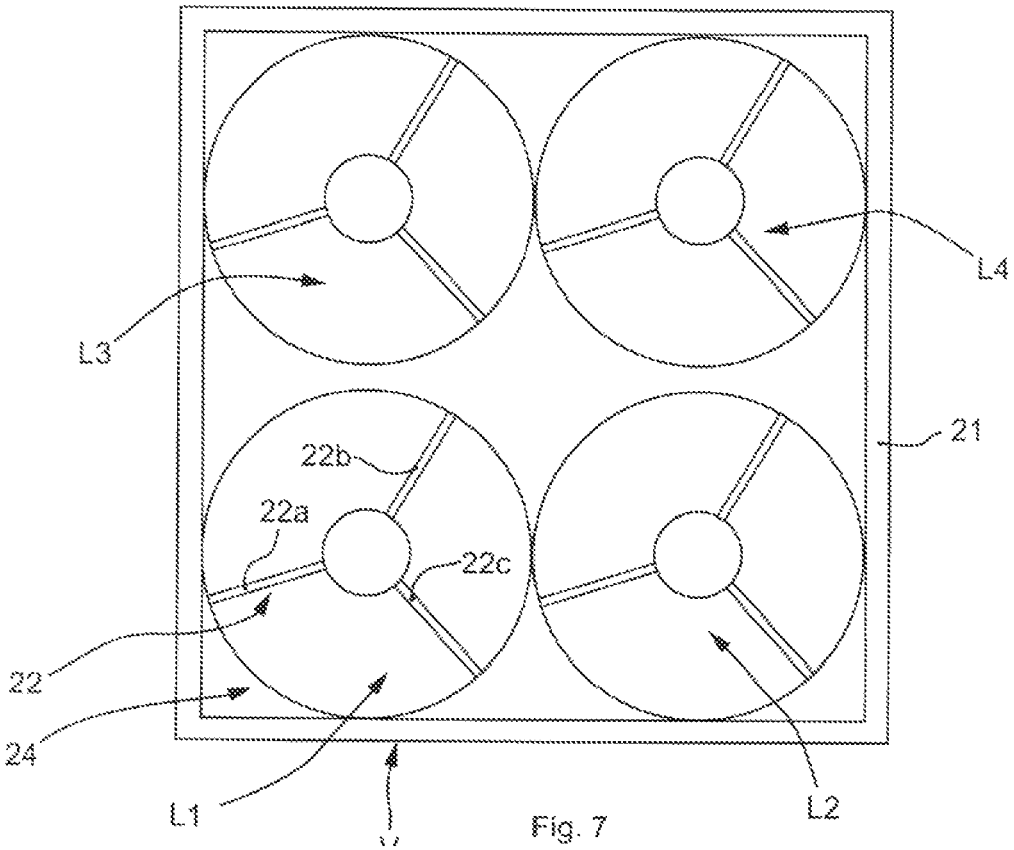
FIG. 7 shows a plan view of a frame as in FIG. 4, but with four fan wheels held on the frame and able to be moved individually relative to the frame by way of supports with different elasticities.
Figure 8:
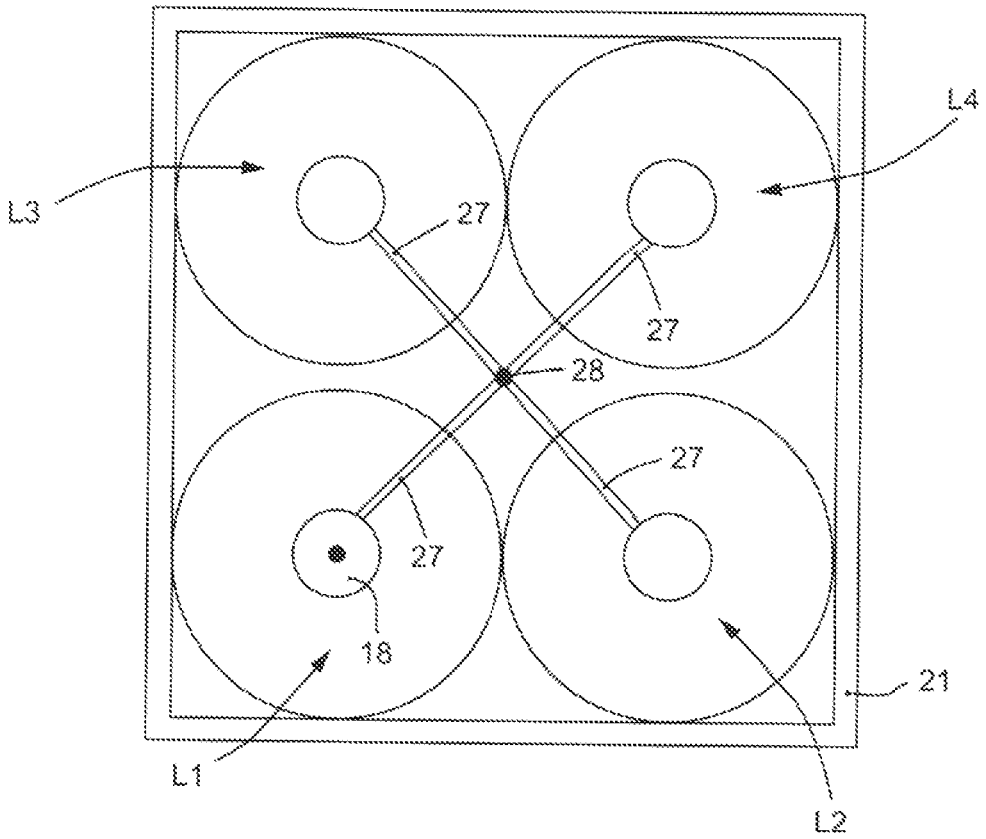
FIG. 8 shows a similar view to the one in FIG. 7 but with the fan wheels held on the frame in such a manner that they can be moved individually by way of pivot levers.

Four fan wheels L1, L2, L3, L4 are shown by way of example in FIG. 7 or FIG. 8. The number is not mandatory. They are arranged in the upper region 16 of the dishwasher cavity 2 here and each comprise a propeller-type part 17 as well as a drive part 18. The motors 18 here are arranged axially close to the top of the fan wheels L1, L2, L3, L4 and can be activated by a control facility outside the dishwasher cavity 2, in other words are also connected electrically thereto. The drives 18 are arranged in particular axially directly above the respective fan wheel L1, L2, L3, L4 and are preferably configured as a flat unit, in particular as a contactless synchronous motor. This advantageously results in a very small structural height with an axial extension of less than four centimeters. The overall structural height of motor 18 and fan wheel 17 is therefore favorably less than five centimeters so assignment to a simply flat flatware drawer 10 or similar loading unit is possible.

Figure 2:
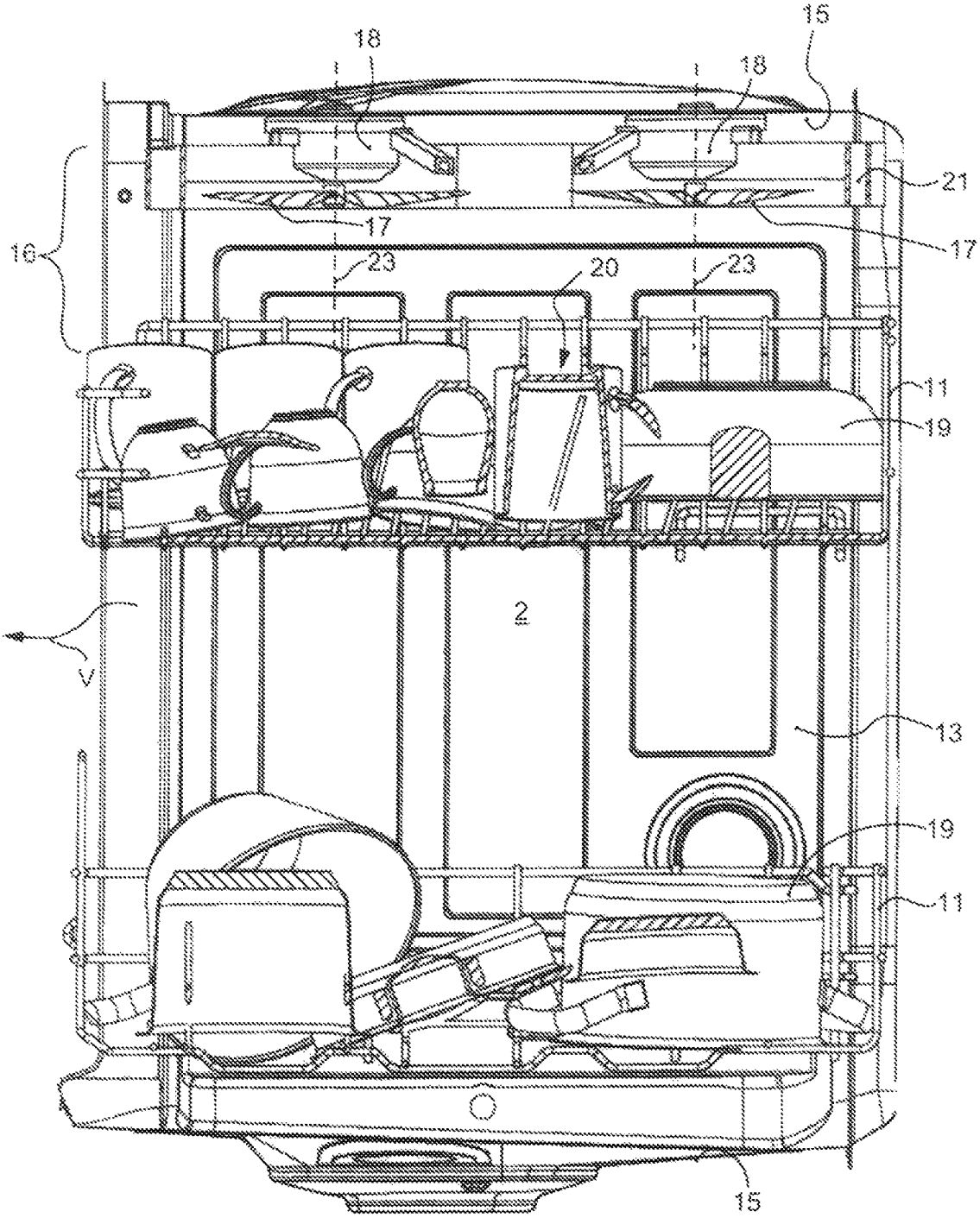
FIG. 2 shows an exemplary detailed view of a dishwasher cavity loaded with items to be washed and a side view of fan wheels positioned below its upper wall, the fan wheels being connected in a rigid manner so that they cannot be tilted relative to a vertical axis in this image.
Figure 3:
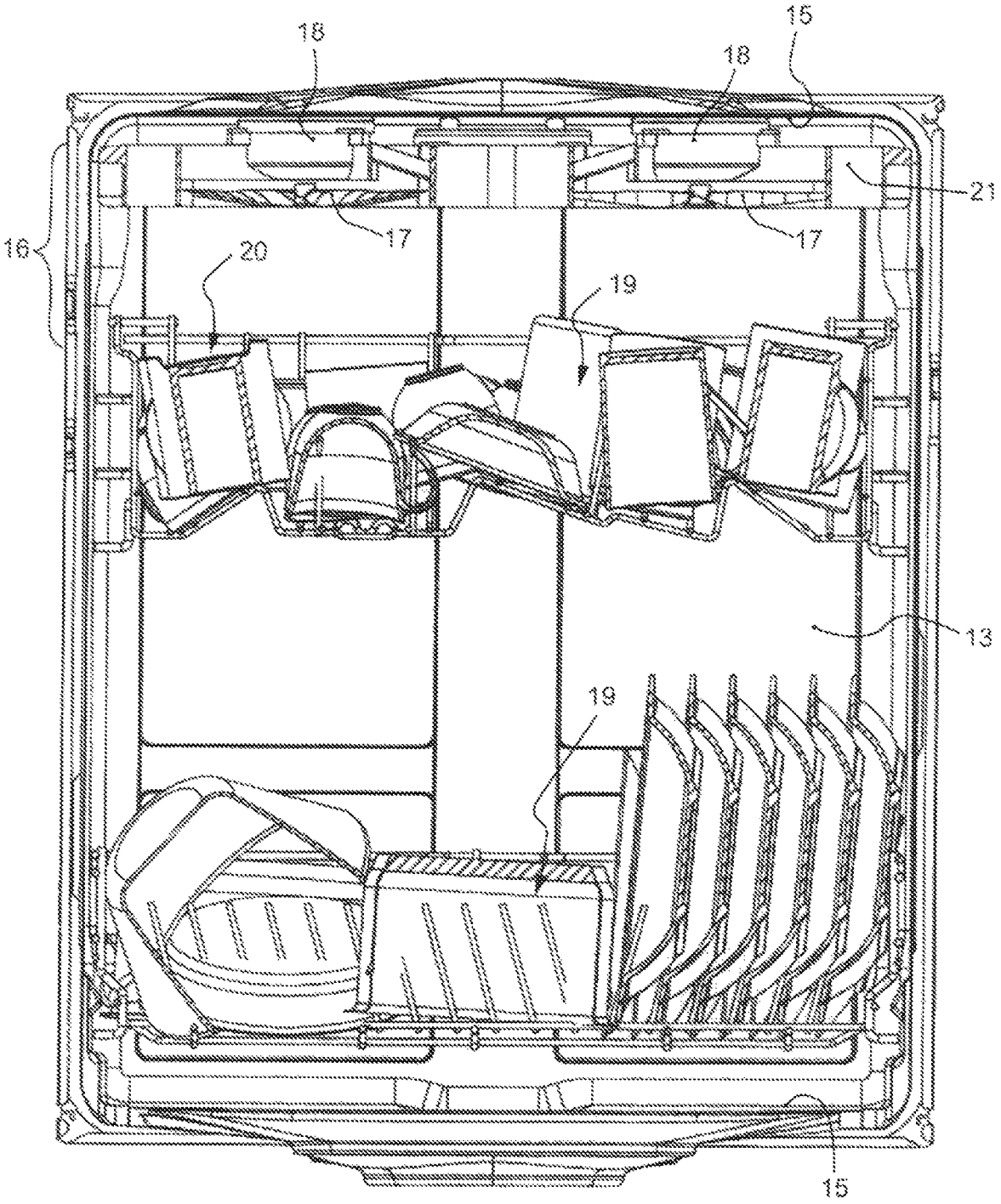
FIG. 3 shows the dishwasher cavity according to FIG. 2 viewed from the front.
Figure 5:
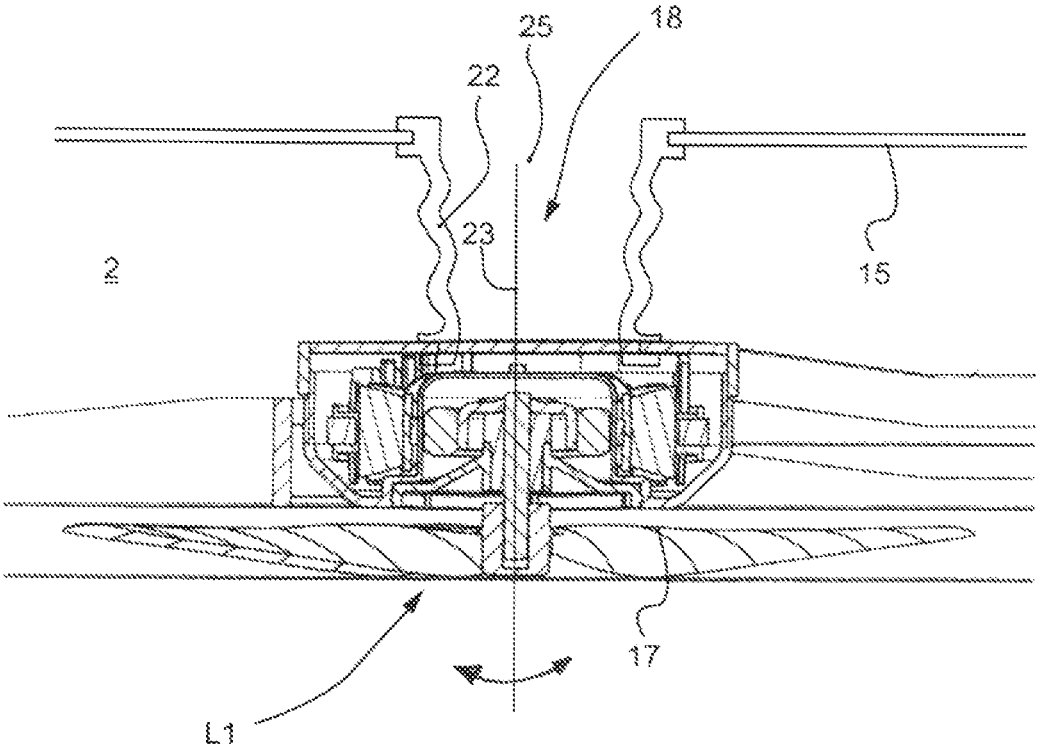
FIG. 5 shows a partial detail of an individual view of a fan wheel suspended by way of a flexible, sealing cuff.

The fan wheels L1, L2, L3 and L4 can be active in the drying phase and serve to improve the drying result for the items 19 being washed, as shown in FIGS. 2 and 3. As they rotate about a vertical axis 23 they convey air and blow it with a downward component onto the items 19 being washed. As according to the invention the respective fan wheel and therefore its blow-out direction are movable relative to the vertical axis 23, rotation does not necessarily take place precisely about said vertical axis 23 but about an axis at a slight angle thereto, which can vary its position, as set out in more detail below. This ability to move is shown at the bottom of FIG. 5 by the pivot arrow about the vertical axis 23 marked there.

The drying result for upward facing cup or glass bottoms 20 or similar hollows, inward curves or the like in particular is greatly improved.

The one or multiple fan wheels L1, L2, L3, L4 is or are assigned to at least one loading unit 10, 11 and/or the upper wall 15 delimiting the dishwasher cavity 2 or a separate frame 21 and held there.

This results in a suspension unit for the fan wheels L1, L2, L3, L4 that can be moved individually or together relative to the respective vertical axis 23. Such ability to move does not refer to rotational movement, which is present anyway, but to the ability of the actual rotation axis to tilt relative to the vertical axis 23. This varying of the output air flow generally improves drying and the drying phase as a whole in respect of energy consumption, runtime, drying effect and ambient influences.

It is also possible for a flatware drawer for example to be divided longitudinally or transversely, thereby eliminating the relevant symmetry. Only the right-hand part from the user's point of view forms a flatware drawer 10 here and can be pulled out forward, toward the front face V, to facilitate loading and unloading in the usual manner. Two fan wheels L1 and L3 of equal size (not shown) can be present instead in the left part when viewed from the front. The fan wheels L1, L3 here can also be in the same horizontal plane as the flatware drawer 10 and do not then have to project downward. This gives the full loading height in the loading unit(s) 11 below, which is very favorable in particular for tall items, such as glasses with a long stem.

Figure 4:
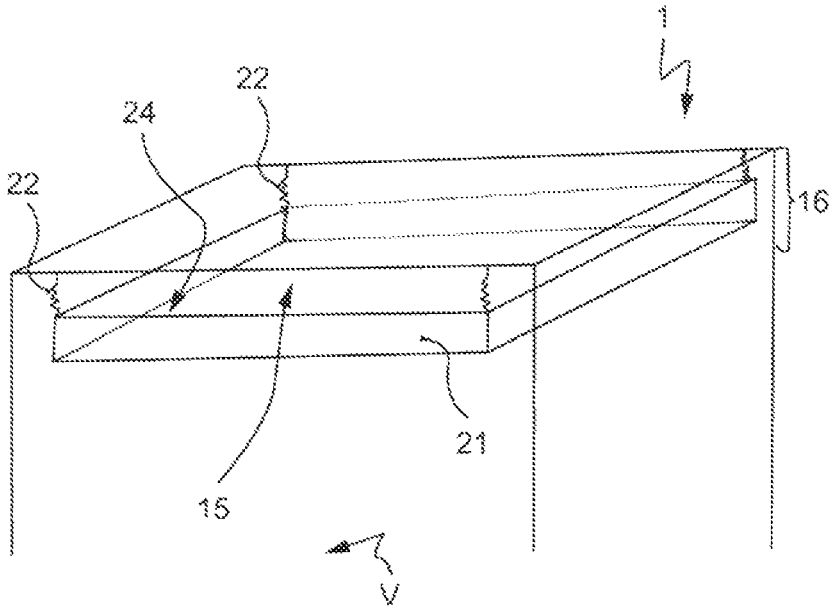
FIG. 4 shows a schematic perspective view of a household dishwasher with a frame held movably at the top by way of four elements, fan wheels (not shown here) being able to be supported or being held on said frame.

In a first shown exemplary embodiment according to FIG. 4 one or multiple fan wheels L1, L2, L3, L4 are suspended from a frame 21, which holds them all. Said frame 21 itself is suspended from a loading unit 10, 11 or—as shown here—from the wall 15 delimiting the top of the dishwasher cavity 2 in such a manner that it can be moved relative to a vertical axis 23. Four suspension units 22 in the outer corner regions for example serve this purpose. Said suspension units 22 can be elastically deformable, the elasticity being achieved by way of support elements containing rubber, silicone and/or TPE/TPV. Alternatively the ability of the suspension units 22 to move can be achieved by way of springs.

This forms an elastic/flexible suspension unit 22 for the complete frame 21 on the dishwasher cavity 2 to secure a pivotable fan system. The fan(s) L1, L2, L3, L4—not shown in FIG. 4—in contrast can be suspended in a fixed manner or even elastically in the frame 21. If there is a rigid suspension unit in the frame 21, the force acting on it due to the operation of the fan wheel, for example L1, outputting air in a downward direction can be directed in its totality onto the frame 21. If for example a fan is arranged in a rigid manner in the front left corner 24 of the frame 21 blowing out in a downward direction, said fan is thrust upward. Said thrust is transferred due to the rigid suspension unit to the frame 21, which then rises at this corner 24 due to its movable suspension units 22 and therefore tilts the fan slightly relative to the vertical. It is possible to run through the speed of said fan in multiple phases so the resulting thrust varies. The fan only rises when the thrust is approximately equal to the weight of said fan. If there are multiple fans held in the frame 21, which is particularly favorable, the fans can be activated one after the other, so different corners of the frame 21 are raised in an alternating manner. This, in conjunction with the soft support 22, causes the frame 21 to be pushed upward in the region of the respectively driven motor, providing the desired change of direction. The change of direction relative to the vertical is only a few degrees up to approx. 5°, as otherwise the corner (for example 24) of the frame 21 moved upward in each instance could hit the top.

The elastic suspension unit 22 also results in decoupling from the walls 13, 14, 15 of the dishwasher cavity 2, thereby also improving noise and vibration responses.

The frame 21 can project down in the manner of an apron, thereby also providing a certain level of protection for the fan wheels L1, L2, L3, L4 as well as preventing interference therewith.

Additionally or alternatively it is also possible for the or each fan wheel L1, L2, L3, L4 to be suspended individually from the holding frame 21 or the wall 15 delimiting the top of the dishwasher cavity 2 in such a manner that it can move at least relative to a vertical axis 23. Elastic suspension of each fan wheel L1, L2, L3, L4 from the frame 21 is therefore possible, said frame 21 being connected in a fixed manner to the dishwasher 1.

Figure 6:
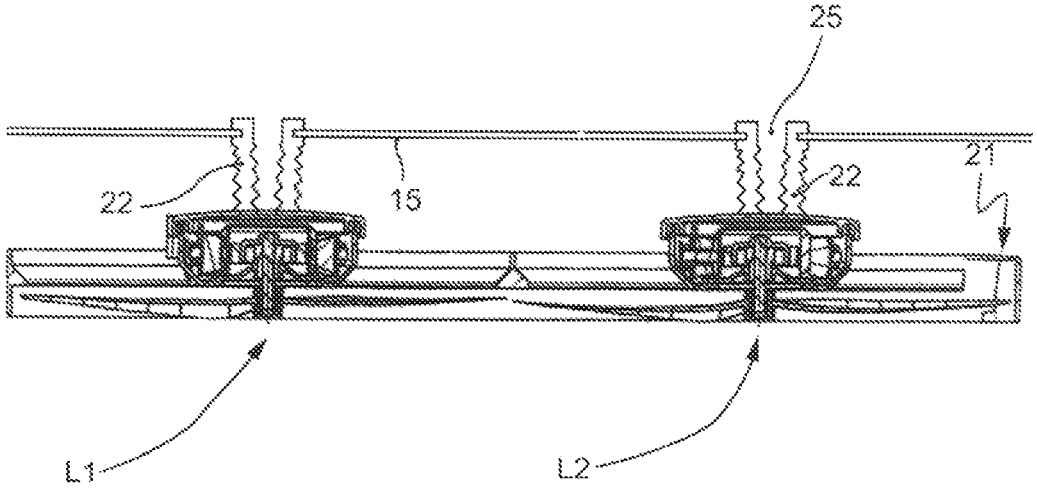
FIG. 6 shows a similar view to the one in FIG. 5 but with two fan wheels next to one another.

Movable suspension of one or each individual fan wheel L1, L2, L3, L4 is shown in FIG. 5 and FIG. 6 for attachment to the upper or top wall 15 of the dishwasher cavity. FIG. 5 shows the attachment of a single fan wheel L1, while FIG. 6 shows the attachment of two fan wheels L1 and L2, which are adjacent to one another when viewed from the front face V. A cuff, which provides a seal and runs around the vertical axis 23 to form an elastically deformable suspension unit 22 is provided here, said cuff in turn containing rubber, silicone and/or TPE/TPV. The suspension unit 22 here is hooked with a form fit into a hole 25 in the upper wall 15. Said hole 25, which penetrates the outer wall 15, means the suspension unit 22 also has to be sealed all round. Other connections and supports are also possible, for example from an auxiliary frame or without a hole through the wall 15. As an alternative to the elastic suspension unit 22 provided by the cuff, a movable suspension unit 22 for the or each fan wheel L1, L2, L3, L4 using one or multiple springs is also possible.

Movable suspension of one or each individual fan wheel L1, L2, L3, L4 is shown in FIG. 7 for elastic attachment to the frame 21. Four fan wheels L1, L2, L3, L4 are provided here by way of example, being assigned to the respective corner regions of the frame 21, which is at least approximately square as shown in a plan view. The suspension unit 22 for each fan wheel (for example L1) relative to the frame 21 is brought about here by way of three strips, holders or other supports 22*a*, 22*b*, 22*c* in each case. These supports 22*a*, 22*b*, 22*c* act in the manner of approximately horizontal connecting webs. They can have different elasticities from one another, so that the thrust of a respective fan wheel L1, L2, L3, L4 produced during operation automatically results in its defined tilt relative to the vertical axis 23. For example the support 22*a* can be much more elastic than the supports 22*b* and 22*c*, with the result that the fan wheel L1 is raised more in an outward transverse direction and the air flow output in a downward direction is directed slightly more in an outward transverse direction into the corner region 24. Here too the supports 22*a*, 22*b*, 22*c* projecting radially from the motor 18 as connecting webs are favorably made of rubber, TPE, etc. and/or in the form of springs. If the three (number not mandatory) supports 22*a*, 22*b*, 22*c* have similar elasticity, a desired limited staggered movement of each fan wheel L1, L2, L3, L4 about the vertical axis 23 is possible during operation.

Figure 9:
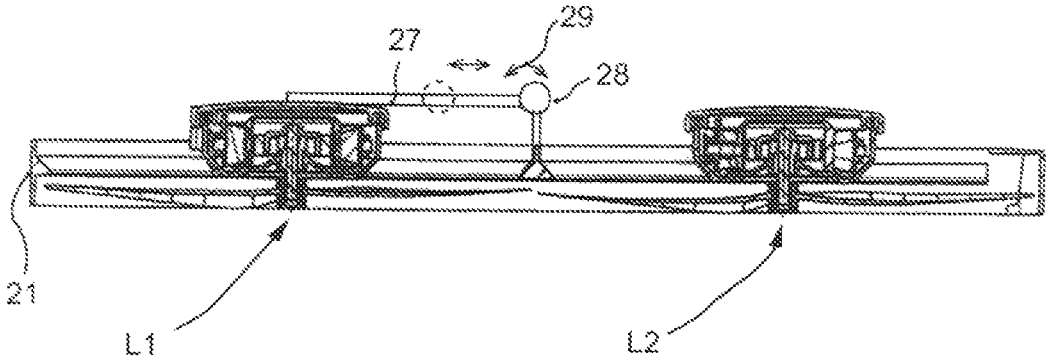
FIG. 9 shows a view from the front of two fan wheels held by way of pivot levers.

In a third embodiment according to FIGS. 8 and 9 the fan wheel(s) L1, L2, L3, L4 is/are fastened to a movable articulated/spherical bearing 28 in the respective suspension unit 22 by way of a pivot lever 27 for example. In the plan view in FIG. 8 the pivot levers 27 run diagonally to a central articulation 28 in the frame 21, so that a staggered movement can take place about the vertical axis 23 during operation. The central arrangement of the articulation 28 is not mandatory. It is also possible for a separate articulation 28 to be provided for each of the fan wheels L1, L2, L3, L4.

The longitudinal distance between the pivot lever 27 and the articulation 28 can vary, so the movement pattern can also be varied.

In all the versions it is possible in particular for a change in the blow-out direction to be preferably brought about solely by operation of the respective fan wheel L1, L2, L3, L4 and the resulting thrust. If multiple fan wheels L1, L2, L3, L4 are present, they can be activated individually. Then for example each fan wheel L1, L2, L3, L4 is run in turn for a few seconds with a vertical blow-out direction and then for a few seconds at full speed to allow a brief oblique blow-out in that the respectively activated fan wheel L1, L2, L3, L4 generates a thrust, which produces movement of said fan wheel in its suspension unit or the multiple fan wheels L1, L2, L3, L4 about a common suspension unit. Activation of the multiple fan wheels L1, L2, L3, L4 one after the other then results in a plurality of blow-out directions and particularly effective drying and particularly effective drying specifically also in the corner regions.

Alternatively or additionally it is also possible for the position of one or multiple fan wheels L1, L2, L3, L4 relative to a vertical axis 23 to be changed from the outside by motor, for example also together by way of a camshaft.

One to four fan wheels L1, L2, L3, L4 in particular are provided for each suspension unit 22.

It is favorable here for one or multiple fan wheels L1, L2, L3, L4 to be held in its or their rest position in a horizontal loading plane of the loading unit 10, 11 or the wall 15. The ability to move can then result during operation in a permanent or in particular an increasing and decreasing tilt of several degrees relative to said plane.

As shown in the plan views, the fan wheel(s) L1, L2, L3, L4 can be arranged with axial symmetry to a vertical longitudinal central plane and/or with axial symmetry to a vertical transverse central plane of the household dishwasher 1.

In contrast to the drawing a single fan wheel L1 arranged centrally in a transverse and depthwise direction can be provided, which can clear the available surface in the dishwasher cavity 2 almost completely with its diameter, in other words can have a diameter up to 48 centimeters.

In the exemplary embodiments described and illustrated here the fan wheels L1, L2, L3, L4 are arranged with axial symmetry to a vertical longitudinal central plane and optionally also with axial symmetry to a vertical transverse central plane of the dishwasher 1. This results in symmetry to the vertical transverse central plane; in other words a user standing in front of the dishwasher 1 sees the same proportions on the left and right.

There is no need for an outer air supply line or discharge line in any instance; instead the one or multiple fan wheels L1, L2, L3, L4 can take in and blow out air from the closed dishwasher cavity 2. It is also possible to open up a gap in the door 3 automatically in the drying phase.

In all the exemplary embodiments the hydraulic action region for cup bottom drying and the like is advantageously enlarged significantly by the movable, in particular pivotable, suspension of one or multiple fan wheels.

The following advantages in particular are generally achieved with the invention:

Enlargement of the hydraulic action region of the drying system and resulting improved drying result, specifically also in the corner regions of the dishwasher cavity, Improvement in noise response due to the decoupling of the motors 18 from the wall 15 or frame 21, and/or Decoupling of vibration of the drying system and/or its drive from the dishwasher cavity and/or other components of the household dishwasher 1.

The one or multiple fan wheels L1, L2, L3, L4 can optionally be assigned to a flatware drawer 10 and/or a rack 11 and/or the separate frame 21 referred to and/or the upper wall 15 depending on configuration and spatial conditions.

Full drying in particular of cup bottoms and similar depressions is possible in the upper and lower racks. This type of drying can also be combined particularly advantageously with a further drying unit, for example using a heat exchanger and/or zeolite.

The invention claimed is:

1. A household dishwasher, comprising:

a dishwasher cavity for accommodating an item to be washed held on or in a loading unit; and at least one rotatable fan wheel arranged in the dishwasher cavity and designed to take in and blow out air as part of a drying cycle of a dishwashing program performed to dry the item to be washed by subjecting the item to be washed to an air flow generated by the at least one rotatable fan wheel, said at least one rotatable fan wheel being suspended movably such that the at least one rotatable fan wheel and a corresponding blow-out direction at which the air is blown out by the at least one rotatable fan wheel are adjustable from a rest position to a tilted position relative to a vertical axis based on a speed at which the at least one rotatable fan wheel is operated.

2. The household dishwasher of claim 1, wherein the at least one rotatable fan wheel is suspended pivotably.

3. The household dishwasher of claim 1, further comprising a frame for support of the at least one fan wheel, said frame being suspended movably from the loading unit or a wall delimiting a top of the dishwasher cavity.

4. The household dishwasher of claim 3, wherein the frame is suspended movably relative to the vertical axis.

5. The household dishwasher of claim 1, wherein the at least one rotatable fan wheel is a plurality of fan wheels, each fan wheel of the plurality of fan wheels being suspended individually from a frame or a wall delimiting a top of the dishwasher cavity such as to move at least relative to the vertical axis, wherein the frame is suspended movably from the loading unit or the wall.

6. The household dishwasher of claim 3, further comprising an elastically deformable suspension unit for support of at least one of the frame and the at least one fan wheel to ensure a movement of the at least one fan wheel.

7. The household dishwasher of claim 6, wherein the elastically deformable suspension unit includes a support element containing rubber, silicone and/or TPE/TPV.

8. The household dishwasher of claim 6, wherein the elastically deformable suspension unit includes a spring.

9. The household dishwasher of claim 6, wherein the elastically deformable suspension unit includes a pivot lever to ensure the movement of the at least one fan wheel.

10. The household dishwasher of claim 1, wherein the at least one rotatable fan wheel is a plurality of fan wheels to enable a change in the corresponding blow-out direction by operating a respective one of the plurality of fan wheels.

11. The household dishwasher of claim 6, further comprising a plurality of said at least one fan wheel configured for individual activation such that activation of a respective one of the plurality of said at least one fan wheel causes the respective one of the plurality of said at least one fan wheel to generate a thrust force which moves the respective one of the plurality of said at least one fan wheel in the suspension unit thereof.

12. The household dishwasher of claim 1, further comprising a plurality of said at least one fan wheel and an elastically deformable suspension unit for common support of the plurality of said at least one fan wheel, wherein the plurality of said at least one fan wheel are activated individually such as to generate a thrust force, which moves the plurality of said at least one fan wheel in the common suspension unit.

13. The household dishwasher of claim 1, further comprising an elastically deformable suspension unit for support of one to four of said fan wheel.

14. The household dishwasher of claim 1, wherein the at least one fan wheel is held in the rest position in a horizontal loading plane of the loading unit or a wall delimiting a top of the dishwasher cavity.

15. The household dishwasher of claim 1, wherein the at least one fan wheel is mounted for rotation about a vertical axis.

16. The household dishwasher of claim 1, wherein the at least one fan wheel is arranged with axial symmetry to a vertical longitudinal central plane and/or with axial symmetry to a vertical transverse central plane of the dishwasher.

17. The household dishwasher of claim 1, wherein the at least one fan wheel has a diameter of 17 to 48 centimeters.

18. The household dishwasher of claim 1, wherein the loading unit comprises a flatware drawer or a rack, and wherein the at least one fan wheel is assigned to the flatware drawer and/or the at least one fan wheel is assigned to the rack and/or a frame.

19. The household dishwasher of claim 1, wherein the at least one fan wheel is configured for a change of the rest position from outside by a motor.

20. The household dishwasher of claim 1, further comprising a control facility electrically coupled to the at least one rotatable fan wheel to activate a corresponding motor of the at least one rotatable fan wheel.

* * * * *